US005520160A

United States Patent [19]

Aota et al.

[11] Patent Number: 5,520,160

[45] Date of Patent: May 28, 1996

[54] FUEL EVAPORATIVE GAS AND AIR-FUEL RATIO CONTROL SYSTEM

[75] Inventors: Hiroyuki Aota, Kariya; Junya Morikawa, Kasugai; Osamu Fukasawa, Obu, all of Japan

[73] Assignee: Nippondenso Co., Ltd., Kariya, Japan

[21] Appl. No.: 295,394

[22] Filed: Aug. 25, 1994

[30] Foreign Application Priority Data

| | | | |
|---|---|---|---|
| Aug. 26, 1993 | [JP] | Japan | 5-211838 |
| Sep. 3, 1993 | [JP] | Japan | 5-219961 |
| Sep. 20, 1993 | [JP] | Japan | 5-233430 |

[51] Int. Cl.[6] ..... F02D 41/14

[52] U.S. Cl. ..... 123/675; 123/698; 123/520

[58] Field of Search ..... 123/674, 675, 123/698, 519, 520

[56] References Cited

U.S. PATENT DOCUMENTS

| | | | |
|---|---|---|---|
| 4,748,959 | 6/1988 | Cook et al. | 123/698 |
| 5,048,492 | 9/1991 | Davenport et al. | 123/674 |
| 5,090,388 | 2/1992 | Hamburg et al. | 123/674 |
| 5,125,385 | 6/1992 | Frinzel | 123/698 |
| 5,271,374 | 12/1993 | Nagaishi et al. | 123/675 |
| 5,400,761 | 3/1995 | Fukasawa et al. | 123/674 |
| 5,406,927 | 4/1995 | Kato et al. | 123/698 |

FOREIGN PATENT DOCUMENTS

| | | |
|---|---|---|
| 63-186955 | 8/1988 | Japan . |
| 63-255559 | 10/1988 | Japan . |
| 63-289243 | 11/1988 | Japan . |
| 2130240 | 5/1990 | Japan . |
| 586923 | 4/1993 | Japan . |
| 5332205 | 12/1993 | Japan . |

*Primary Examiner*—Willis R. Wolfe

[57] ABSTRACT

A system for solving disturbances in the air-fuel ratio caused by a change in the normal correction factor, and permitting achievement of a highly accurate air-fuel ratio control. Fuel evaporative gas generated in a fuel tank is adsorbed in a canister, and then discharged into an intake pipe of an internal combustion engine. ECU calculates the fuel supply quantity to the internal combustion engine on the basis of the condition in which the internal combustion engine is operating, performs feedback control and learning control of an air-fuel ratio on the basis of a detection signal from an oxygen sensor, and corrects the fuel supply quantity by means of an air-fuel correction factor. ECU also controls fuel injection by an injector by decrement-correcting the fuel supply quantity in response to the quantity of discharged evaporative gas. Furthermore, ECU adjusts, upon decrement correction of the fuel supply quantity in response to the quantity of discharged evaporative gas, the quantity of the decrement correction so as to be proportional to the normal correction factor including the air-fuel ratio correction factor.

13 Claims, 9 Drawing Sheets

FULL-OPEN PURGE RATIO MAP (%)

| NE \ PM | 291 | 369 | 447 | 525 | 603 | 651 | 759 (mmHg) |
|---|---|---|---|---|---|---|---|
| 800 | 20.1 | 14.5 | 11.2 | 8.6 | 6.2 | 4.6 | 0.0 |
| 1200 | 12.5 | 9.3 | 7.2 | 5.5 | 4.0 | 2.9 | 0.0 |
| 1600 | 9.3 | 6.8 | 5.3 | 4.0 | 2.9 | 2.1 | 0.0 |
| 2000 | 7.9 | 5.7 | 4.4 | 3.3 | 2.4 | 1.8 | 0.0 |
| 2400 | 6.0 | 4.5 | 3.5 | 2.6 | 1.9 | 1.4 | 0.0 |
| 2800 | 5.5 | 4.1 | 3.1 | 2.3 | 1.7 | 1.2 | 0.0 |
| 3200 | 4.9 | 3.6 | 2.7 | 2.0 | 1.5 | 1.1 | 0.0 |
| 3600 | 4.1 | 3.0 | 2.2 | 1.7 | 1.3 | 0.9 | 0.0 |
| 4000 | 3.4 | 2.4 | 1.8 | 1.4 | 1.1 | 0.8 | 0.0 |

(rpm)

·AT IDLE
KTPRG = −30%

·AT NON-IDLE

| NE | 500 | 1000 | 1500 | 2000 | 2500 | 3000 | 3500 | 4000 |
|---|---|---|---|---|---|---|---|---|
| KTPRG | −30 | −30 | −35 | −40 | −40 | −45 | −45 | −50 |

| NE \ PM | 300 | 350 | 400 | 450 | 500 | 550 | 600 | 650 | 700 | 750 |
|---|---|---|---|---|---|---|---|---|---|---|
| 500 | −30 | −30 | −30 | −35 | −35 | −35 | −35 | −40 | −40 | −40 |
| 1000 | −30 | −30 | −30 | −35 | −35 | −35 | −35 | −40 | −40 | −40 |
| 1500 | −30 | −30 | −30 | −35 | −35 | −35 | −35 | −40 | −40 | −45 |
| 2000 | −35 | −35 | −35 | −35 | −35 | −40 | −40 | −40 | −45 | −45 |
| 2500 | −35 | −35 | −35 | −35 | −40 | −40 | −45 | −45 | −50 | −50 |
| 3000 | −40 | −40 | −40 | −40 | −40 | −40 | −45 | −50 | −50 | −50 |
| 3500 | −40 | −40 | −40 | −40 | −40 | −45 | −50 | −50 | −50 | −50 |
| 4000 | −40 | −40 | −40 | −40 | −45 | −45 | −50 | −50 | −50 | −50 |

FIG. 11
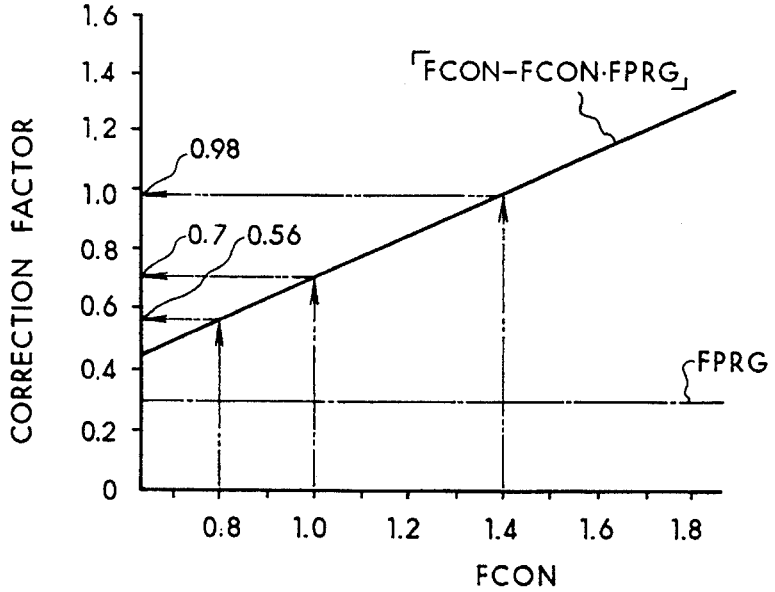
FIG. 12
| mmHg \ Hz | 10 | 20 | 30 | ----- |
|---|---|---|---|---|
| 40 | 12 | 19 | 27 | ----- |
| 80 | 13 | 21 | 29 | ----- |
| 120 | 14 | 23 | 31 | ----- |
| 160 | 15 | 25 | 33 | ----- |
| 200 | 16 | 27 | 36 | ----- |
| 300 | 18 | 30 | 40 | ----- |
| 450 | 18 | 30 | 40 | ----- |
(%)
FIG. 13
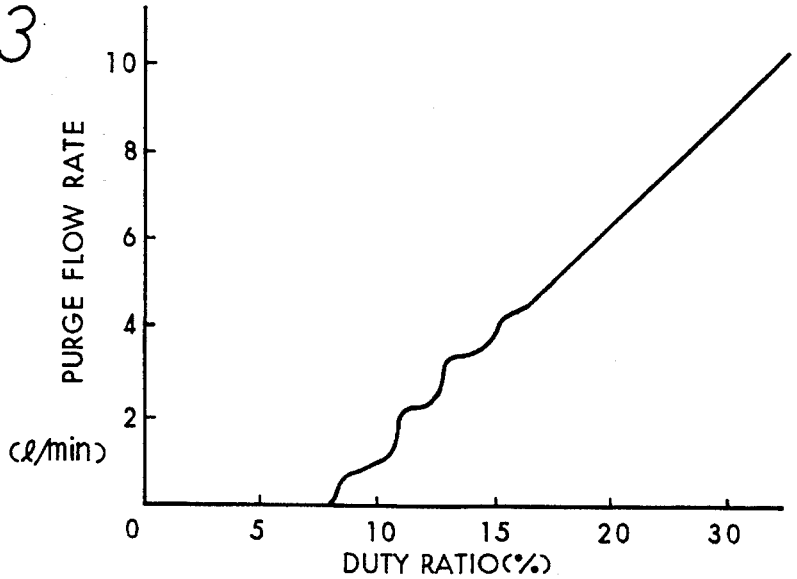

FUEL EVAPORATIVE GAS AND AIR-FUEL RATIO CONTROL SYSTEM

BACKGROUND OF THE INVENTION

1. Field of the Invention

The present invention relates to a canister purging apparatus, which causes a canister to adsorb fuel evaporative gas generated in a fuel tank of an internal combustion engine and to purge fuel evaporative gas during a prescribed engine operating state into a suction pipe. Furthermore, the present invention relates to an air-fuel ratio control system.

2. Related Art

Canisters have recently been designed so as to have larger capacities, which respond to evapo-emission and OVR regulations enacted in the United States. Quick purging of a fuel-evaporative gas, which is adsorbed in large quantities in a large-capacity canister, is thus required. Under these circumstances, conventional techniques have been proposed for improving the ability to control the air-fuel ratio by correcting the quantity of injected fuel in response to the concentration of evaporative fuel during purging and by controlling the purging flow rate. For example, Japanese Patent Provisional Publication No. 63-289,243 discloses such a technique.

However, the method and apparatus disclosed in such a document only allow control of a purge valve in a fully open or fully closed state. The fully open state is thus maintained at a small value so as to ensure that an enriched air condition never occurs, even if the purge valve is fully opened and the fuel evaporative gas is at its highest concentration. In some states where purging large quantities of fuel evaporative gas is desirable, such as during high-load operation, it is impossible to increase the amount of purging. Because the purge valve can be controlled only at a fully open or fully closed state, purging cannot be accomplished when the operating state is one where using a fully-opened purge valve results in an enriched condition. Thus, even if slight purging might be possible, the system is unable to accomplish purging. Even when fuel evaporative gas is generated in large quantities, such as when the engine is run in the summer, it is impossible to increase the amount that the engine can purge or increase the operating condition that allows purging. This results in a canister that suffers from too great a load and increases the risk of fuel evaporative gas being discharged in large quantities.

A system is also available that corrects the purge flow rate by relying upon duty control. In this system, however, air intake quantity and the number of engine revolutions determine the purge quantity. The purge quantity is controlled irrespective of how much fuel evaporative gas is adsorbed into the canister. This system is thus limited in its use, in that purging is only permitted in an operating condition such that the extent of fuel concentration being purged is not important.

Conventionally there have been systems that permit purging for only a limited amount of operations, or systems that permit purging in a limited quantity.

A conventional air-fuel ratio control system requires that a feedback correction factor, including both an air-fuel ratio correction factor and a learning value, be monitored to reduce the difference in the air-fuel ratio between an actual ratio observed with an air-fuel ratio sensor and a target ratio. Feedback control and learning control of the air-fuel ratio are performed by means of this air-fuel ratio correcting factor (feedback correcting factor and learning value). The quantity of fuel supplied to the internal combustion engine is changed in response to the quantity of discharge (purged) evaporative gas, thus determining the quantity of injected fuel for the injector. Such a system is, for example, disclosed in Japanese Patent Provisional Publications Nos. 63-186,955 and 2-130,240.

More specifically, in such an air-fuel ratio control system, an evaporative gas purge correction factor is set so as to be proportional to the quantity of discharged evaporative gas. The quantity of supplied fuel based on the evaporative gas is estimated by means of multiplying the evaporative gas purge correction factor and the quantity of fuel supplied to the internal combustion engine. Such a product is called the corrected decrement quantity. By subtracting this quantity of supplied fuel in the form of evaporative gas from the quantity of fuel supplied to the internal combustion engine, a quantity of injected fuel for the injector may be calculated. The evaporative gas purge correction factor indicates the ratio of the quantity of the fuel supplied in the form of evaporative gas relative to the quantity of supplied fuel to the internal combustion engine during operation of the engine.

A problem found in conventional air-fuel ratio control system, such as those described above, is that, when the constant correction factor including the air-fuel ratio correction factor is different than 1.0, the quantity of injected fuel from the injector deviates from the desired control target value. This exerts an adverse effect on the control of the air-fuel ratio.

Furthermore, another conventional air-fuel ratio control system for internal combustion engines is disclosed in Japanese Patent Provisional Publication No. 63-255,559. This system is based on a method of gradually changing a purge ratio, which has been previously set in compliance with operational conditions of an internal combustion engine (engine revolutions, quantity of air intake, etc.) until a prescribed value is reached, thus reducing the difference between the air-fuel ratio of the mixture of gas or fuel supplied to the internal combustion engine and air. The target air-fuel ratio is also reduced, caused by the delay in detection response.

When the purge ratio is very low in the air-fuel ratio control of an internal combustion engine, or when, in spite of a rather high purge ratio, the absolute flow rate of air intake upon idling is very low, it is possible that the duty ratio for pulsation-driving of a VSV (Vacuum Switching Valve), which is a flow control valve for purging, drops. When this duty ratio decreases to under 15% as shown in FIG. 2, pressure pulsations in the intake manifold and variation of the purge flow rate result in considerable fluctuations of the air-fuel ratio. Hence, such fluctuations result in a deteriorated discharge emission.

SUMMARY OF THE INVENTION

The present invention was developed to solve the above-mentioned problems.

The first object of the present invention is to provide a canister purge apparatus which permits increasing the quantity of the purged evaporative gas and also expands the applicable range of the purging operation. Furthermore, it is an object of the present invention to prevent breakage of the canister by enabling purging to as great an extent as possible, without the purging causing any problems in the control of the air-fuel ratio.

The second object of the present invention is to provide an air-fuel ratio control system for an internal combustion engine that eliminates disturbances of the air-fuel ratio caused by fluctuations in the constant correction factor. Further, it is an object of the invention to achieve high accuracy control of the air-fuel ratio.

The third object of the present invention is to provide a air-fuel ratio control system for an internal combustion engine, which can stably supply a purge flow rate without using the low-duty ratio region, which would cause unstable operation of the internal combustion engine, when purge control is being performed using a flow-control valve.

With the canister purge apparatus according to the present invention, a critical purge means conducts purge flow rate control based on a purge control valve within a limit of decrement correction of the quantity of injected fuel in air-fuel ratio control so as to approach this limit of decrement correction as closely as possible, taking account the detection results of a concentration detecting means and an operating status detecting means. When the fuel evaporative gas concentration in the purged gas is low, it is possible to purge the largest possible quantity of gas. Furthermore, since the purge flow rate is determined to be within a limit of decrement correction of the quantity of injected fuel in air-fuel ratio control, no trouble occurs in the control of the air-fuel ratio. The purge flow rate is determined to be within the limit of decrement correction of the quantity of injected fuel during air-fuel ratio control, even when a high concentration of fuel evaporative gas is present in the purged gas. Purging is therefore possible even during low-load operation such as idling. According to the canister purge apparatus of the present invention, remarkable effects are obtained as it is possible to increase the quantity of the purged gas or to expand the applicable range of the purging operation and to prevent breakage of the canister by maximizing the purging, without causing any problems in the control of the air-fuel ratio by purging.

According to yet another aspect of the present invention, a fuel evaporative gas discharge mechanism causes fuel evaporative gas once generated in a fuel tank to be adsorbed into the canister, and then discharges it to an air intake passage in the internal combustion engine. A fuel supply quantity calculating means calculates the fuel supply quantity supplied to the internal combustion engine on the basis of the operating status of the internal combustion engine by an operating status detecting means. An air-fuel ratio control means performs feedback control and learning control on the basis of the results of detection by an air-fuel ratio sensor, and causes an injector to inject fuel in a quantity corrected by means of the air-fuel ratio correcting factor from the fuel supply quantity calculated by the fuel supply quantity calculating means. An injected fuel reducing means decrement-corrects the corrected fuel quantity determined by the air-fuel ratio control means in response to the quantity of fuel evaporative gas discharged by the fuel evaporative gas discharge mechanism. In this case, the injected fuel reducing means performs decrement correction in an amount proportional to a constant correction factor including the air-fuel ratio correcting factor from the air-fuel control means. In summary, when the constant correction factor is kept at a constant value (for example, "1.0") the value of decrement correction of the fuel supply quantity determined by the injected fuel reducing means may be set primarily in response to the quantity of fuel evaporative gas discharged by the fuel evaporative gas discharge mechanism. However, when the constant correction factor, including the air-fuel ratio correcting factor, varies from a constant value as a result of changes caused by time or individualized differences between systems, causing variation of the fuel quantity corrected by the air-fuel control means, simple decrement correction based on the quantity of discharge of fuel evaporative gas would lead to insufficient or excessive injected fuel, and would cause the air-fuel ratio to shift to the leaner or richer side. When making the decrement correction proportional to the constant correction factor as in the present invention, in contrast, the fuel quantity corrected by the air-fuel ratio control means is always controlled to a desired quantity irrespective of variations in the constant correction factor. Consequently, the injection of excessive or insufficient fuel is inhibited by a stable air-fuel ratio, and thus accurate control of the air-fuel ratio is always ensured. A transient correction factor necessary for transient operation of the internal combustion engine is set, so that, during transient operation of the internal combustion engine, incremental correction of the fuel quantity corresponding to the transient correction factor is performed. In addition, the decrement correction of the fuel quantity is set by the injected fuel reducing means. Incremental correction of the transient operation is set in response to the transient level, and should preferably be performed separately from the other corrections (air-fuel ratio correction based on the air-fuel ratio correcting factor and decrement correction regarding fuel evaporative gas).

Furthermore, in still another aspect of the present invention, the air-fuel ratio of the mixed gas supplied to the internal combustion engine on the basis of the detected air-fuel ratio is feedback-controlled. The purge ratio of the air containing evaporative fuel stored in the canister is controlled by a flow control valve. A purge flow rate is calculated at this point by multiplying the increased or decreased purge ratio on the basis of deviations of the air-fuel ratio from the theoretical or stoichiometric air-fuel ratio derived from feedback control by the quantity of air intake of the mixed gas. If the duty ratio determined from the thus calculated purge flow rate exceeds a prescribed value, the flow control valve is controlled by the duty ratio, and thus fuel evaporative gas is stably discharged and purged to the air intake side of the internal combustion engine.

BRIEF DESCRIPTION OF THE DRAWINGS

These and other objects and features of the present invention, as well as methods of operation and the functions of interrelated parts, will become apparent to a person of ordinary skill in the art from a study of the following detailed description, appended claims and figures, all of which form a part of this specification. In the figures:

Figure 7:
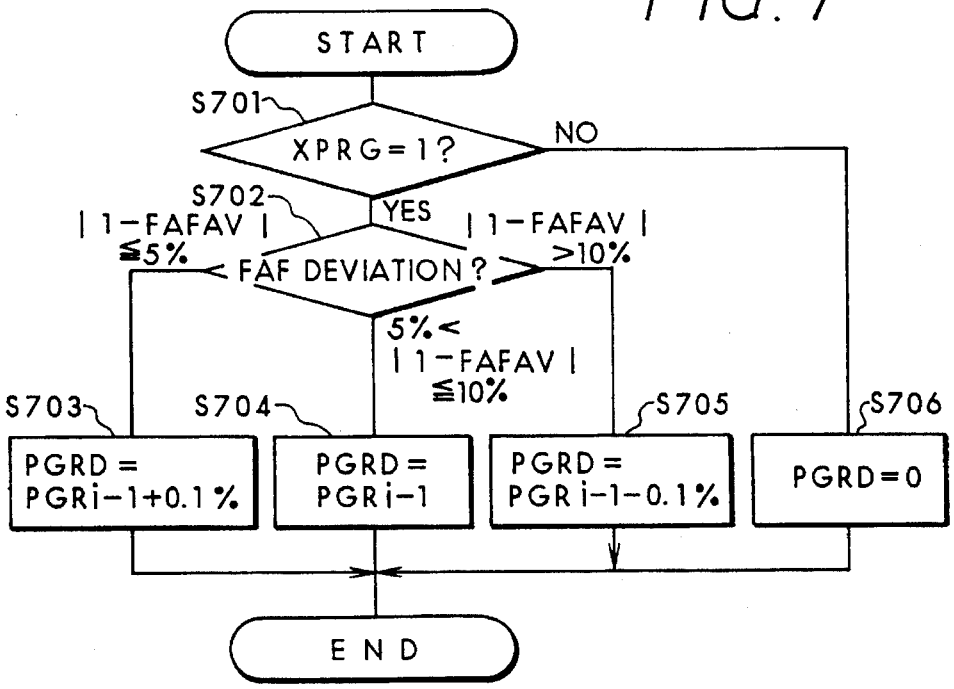
Figure 10:
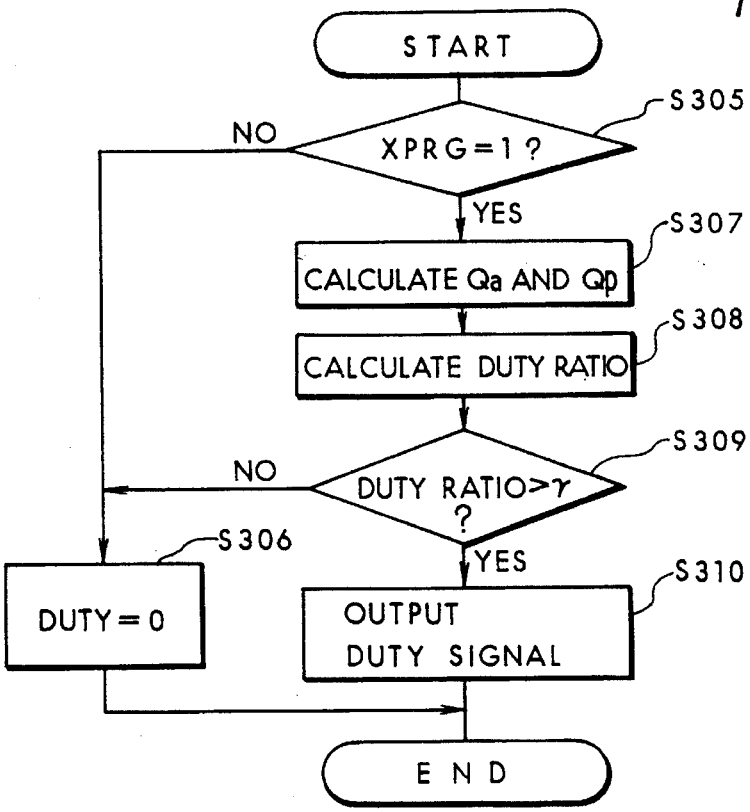
Figure 8:
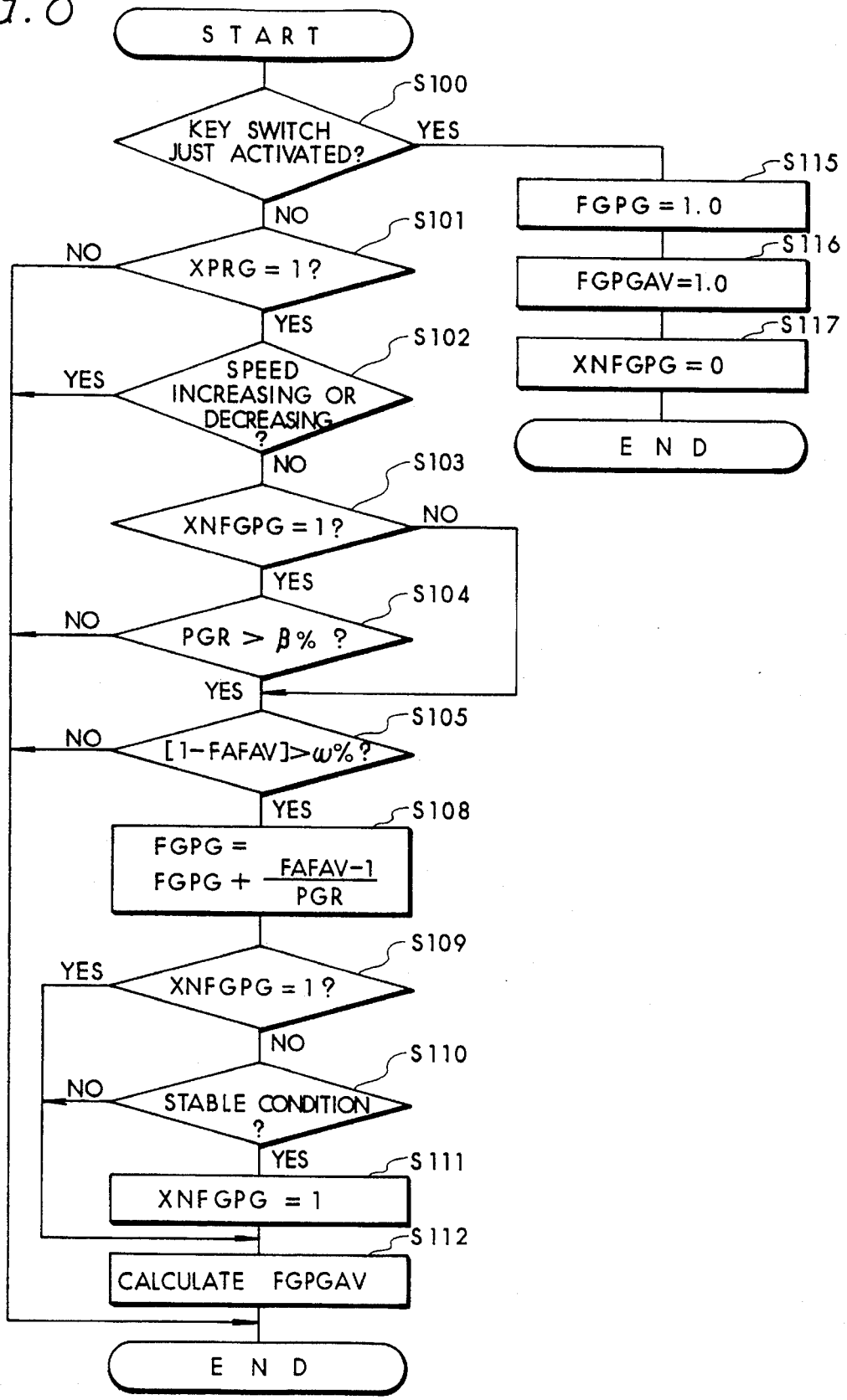
Figure 9:
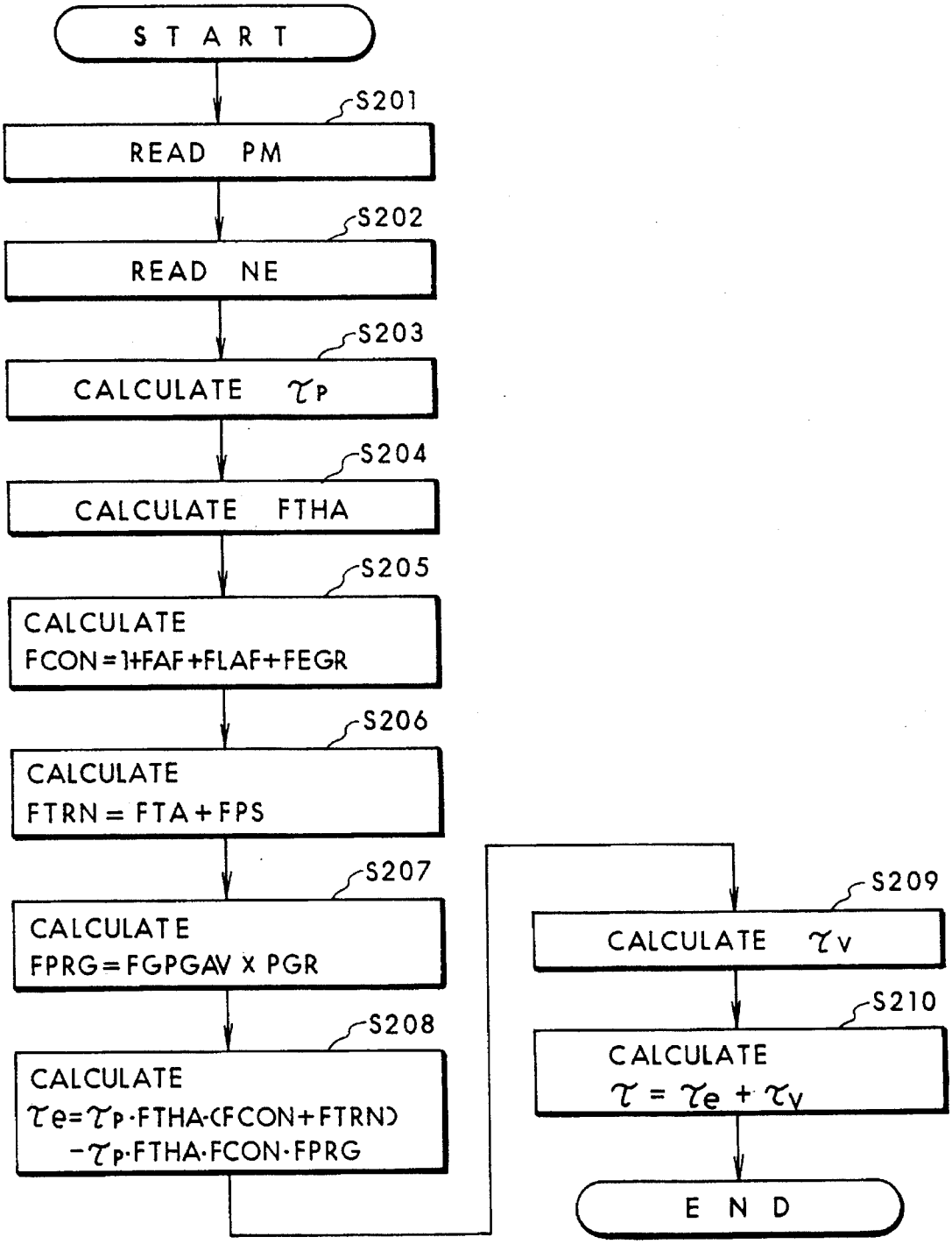

FIGS. *6a–6c* are maps illustrating the target TAU correction quantity KTPRG, which is the critical correction quantity for various operating conditions in air-fuel ratio control;

FIG. 7 is a flowchart illustrating the slow changes to the control of the purge ratio;

FIG. 8 is a flowchart illustrating the detection control of fuel evaporative gas concentration;

FIG. 9 is a flowchart illustrating the fuel injection control routine;

FIG. 10 is a flowchart illustrating the purge solenoid valve control routine;

FIG. 11 is a graph illustrating changes in factor values resulting from variation of the constant correction factor;

FIG. 12 is a map illustrating the critical duty ratio in air-fuel ratio control; and FIG. 13 is a map illustrating the relationship between the purge flow rate and the duty ratio.

DETAILED DESCRIPTION OF THE PRESENTLY PREFERRED EXEMPLARY EMBODIMENTS

Now, the various embodiments of the present invention will be described with reference to the attached drawings.

Figure 1:
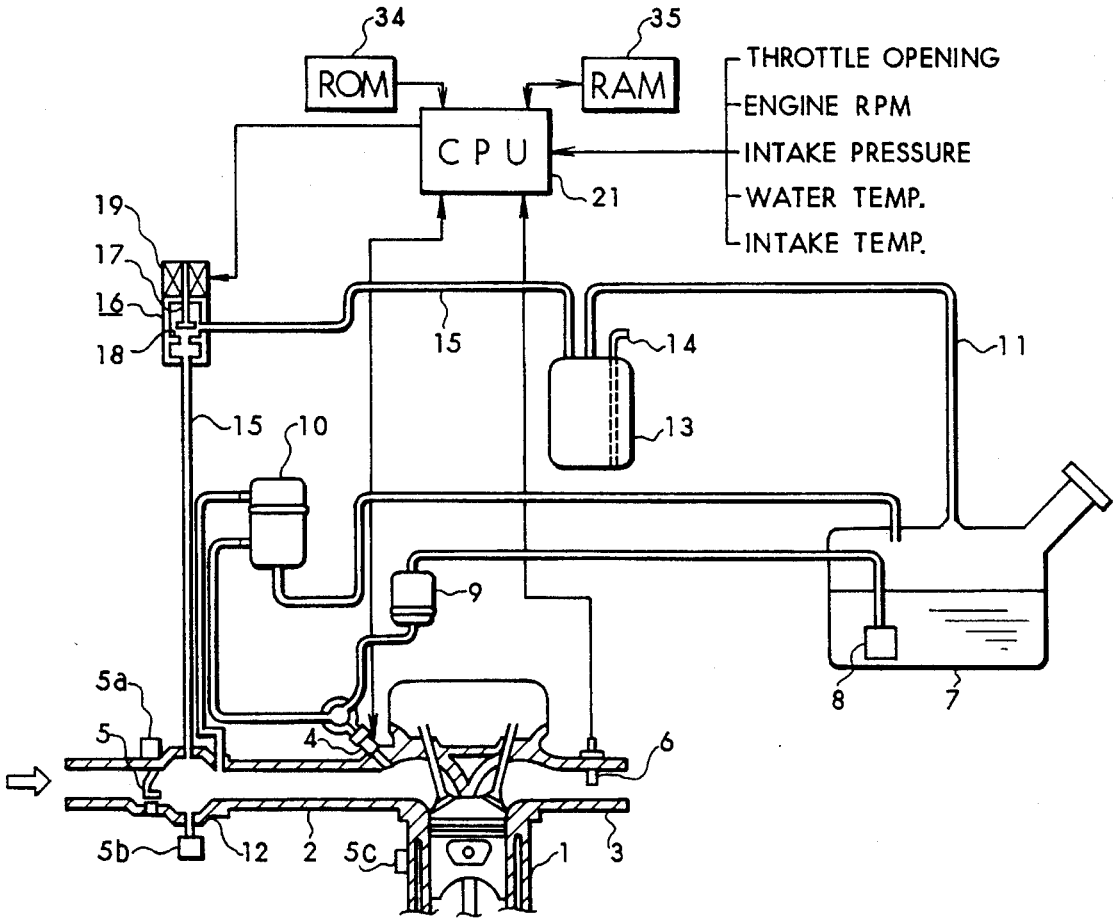
FIG. 1 is a schematic view illustrating the system according to one embodiment of the present invention.

As shown in FIG. 1, multiple-cylinder internal combustion engine 1 is mounted on a vehicle, and air intake pipe 2 and exhaust pipe 3 are connected to engine 1. Electromagnetic injector 4 is provided at an inner end of air intake pipe 2, and throttle valve 5 is provided in the upstream side thereof. In addition, oxygen sensor 6 provided in exhaust pipe 3 outputs a voltage signal corresponding to the oxygen concentration in the exhaust gas.

The fuel supply system supplying fuel to injector 4 includes fuel tank 7, fuel pump 8, fuel filter 9 and pressure regulator or relief valve 10. Fuel (gasoline) in fuel tank 7 is pressure-transferred to each injector 4 through fuel filter 9 by fuel pump 8. Fuel supplied to each injector 4 is adjusted to a prescribed pressure by the relief valve 10.

A purge pipe 11 extends from the upper portion of fuel tank 7 and communicates with a surge tank 12 of the air intake pipe 2. Canister 13 contains activated carbon as an agent for adsorbing fuel evaporative gas generated in the fuel tank and is disposed in the middle of purge pipe 11. Open-air hole 14 introduces air to canister 13. The portion of purge pipe 11 connected to surge tank 12 following canister 13 serves as discharge path 15. Variable-flow electromagnetic valve 16 (hereinafter referred to as the "purge solenoid valve") is provided in the middle of discharge path 15. In purge solenoid valve 16, valve body 17 is always pressed by a spring (not shown) in the direction so as to close seat portion 18, and is also influenced by exciting coil 19. Therefore, by de-energizing coil 19 of purge solenoid valve 16, discharge path 15 is closed, and excitation of coil 19 causes discharge path 15 to open. Opening of purge solenoid valve 16 is smoothly adjustable from full closing to full opening by CPU 21 described later with respect to duty ratio control based on pulse width modulation.

Figures 2, 3:
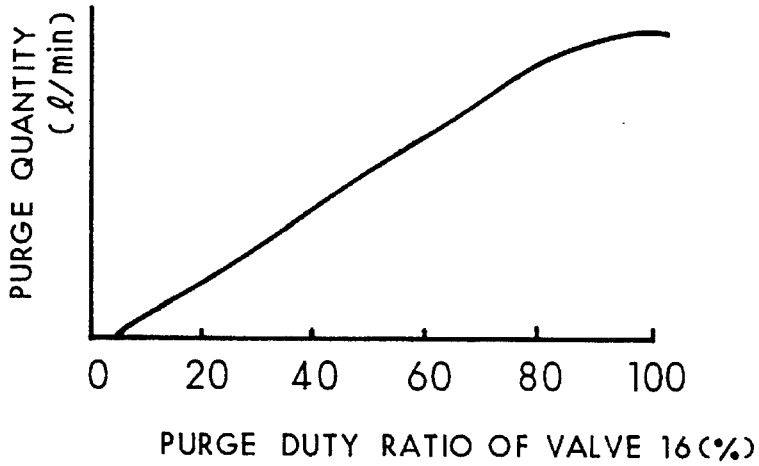
FIG. 2 is a graph illustrating flow rate characteristics of a purge solenoid valve.
FIG. 3 is a map illustrating the purge gas mixing ratio at full opening (full-opening purge ratio PRGMX) of the purge solenoid valve in various operating conditions.

Therefore, when a control signal is supplied to purge solenoid valve 16 from CPU 21 so that canister 13 communicates to the air intake pipe 2 of the engine 1, fresh air Qa is introduced from the atmosphere, which ventilates canister 13 and is sent through air intake pipe 2 of engine 1 into the cylinders. Thus canister purge is accomplished for recovery of the adsorbing function of canister 13. The quantity Qp (liter/min) of introduced fresh air Qa is adjusted by changing the duty of the pulse signal supplied by CPU 21 to purge solenoid valve 16. FIG. 2 is a characteristic diagram of the quantity of purge at this point, illustrating the relationship between the duty of purge solenoid valve 16 and the quantity of purge on an assumption of a constant negative pressure within the air intake pipe. It is known from FIG. 2 that as the duty ratio of the purge solenoid valve 16 is increased from 0%, the quantity of purge, i.e., the quantity of air aspirated through the canister 13 into the engine 1 increases.

CPU 21 receives (1) a throttle opening signal from throttle sensor 5*a*, which detects the opening of throttle valve 5, (2) an engine revolution signal from a revolution sensor (not shown), which detects revolutions of the engine 1, (3) an air intake pressure signal from air intake pressure sensor 5*b*, which detects pressure of aspirated or intake air having passed through throttle valve 5 (this may be replaced by an aspirated air quantity signal from an aspirated or intake air quantity sensor), (4) a cooling water temperature signal from water temperature sensor 5*c*, which detects the temperature of engine cooling water, and (5) an aspirated or intake air temperature signal from an aspirated air temperature sensor (not shown) which detects aspirated air temperature. CPU 21 also receives a signal (voltage signal) from the above-mentioned oxygen sensor 6, and determines whether the air-fuel mixed gas subjected to combustion in engine 1 is rich or lean based on the signal from sensor 6. Upon changing from rich to lean or vice versa, CPU 21 causes a stepwise change (skip) of the feedback correction factor to increase or decrease the quantity of injected fuel. In a rich or lean condition, CPU 21 conducts time dependent slow and gradual increase or decrease of the feedback correction factor. No feedback control is applied at a low engine cooling water temperature or during operation under a high load at a large number of revolutions. CPU 21 calculates a basic injection time from the engine revolutions and the air intake pressure, determines the final injection time through correction of the basic injection time by means of the feedback correction factor and the like, and thus causes injector 4 to perform fuel injection at a prescribed timing of injection.

ROM 34 stores programs and data maps for controlling operation of the engine as a whole. RAM 35 temporarily stores various data including the opening of throttle valve 5, engine revolutions and other detected data. CPU 21 controls engine operations in compliance with the program stored in ROM 34.

FIG. 3 shows the full-opening purge ratio map, determined by the engine revolutions Ne and the load (this may be the air intake pressure, quantity of air intake or throttle opening). This map indicates the ratio of the quantity of air flowing through discharge path 15 upon 100% duty of purge solenoid valve 16 relative to the total quantity of air coming through air intake pipe 2, into engine 1. This map is stored in ROM 34. This system performs fuel injection control through air-fuel ratio feedback (FAF) control, purge ratio control, detection of the fuel evaporative gas (EVAPO) concentration, fuel injection control, and solenoid valve control. The operation of the respective parts of the first embodiment is described below.

Air-fuel ratio feedback control

Air-fuel ratio feedback control is described with reference to FIG. 4. Here, air-fuel ratio feedback control is performed by CPU 21 base routine every about 4 msec. First, it is determined whether or not feedback (F/B) control is applicable at step S40. F/B control is determined to be applicable only when all the following conditions are satisfied:

(1) The engine has not just been started; (2) the supply of fuel to the engine is not being cut; (3) the temperature of the cooling water (THW)≧40° C.; (4) $TAU>TAU_{min\ o}$; and (5) the oxygen sensor is activated or activated.

When all these conditions are met, processing proceeds to step S42, where the oxygen sensor output 0X is compared with a prescribed determination level, and an air-fuel ratio flag XOXR operates in response to the oxygen sensor output with a delay time H msec, I msec, respectively. More specifically, the flag is set to XOXR=0 (meaning a lean condition) after the lapse of H msec from reversal of the oxygen sensor output from rich to lean, and the flag is operated to XOXR=1 (meaning a rich condition) after the lapse of I msec from reversal of the oxygen sensor output from lean to rich. Then at step S43, the FAF value is operated or calculated on the basis of this XOXR. Namely, when XOXR changes as (0→1) or (1→0), the FAF value skips by a prescribed amount (proportional control), and while the XOXR value remains at 1 or 0, the FAF value subjected to integral control to be varied gradually. After checking the upper and lower limits of the FAF value at the next step S44, averaging is conducted on the basis of the FAF value thus determined for each skip or every prescribed period of time to determine an average value FAFAV at step S45. When F/B control is not validated at step S40, the FAF value is set at 1.0 at step S46 so that no feedback control is effected.

Purge ratio control

Figure 5:
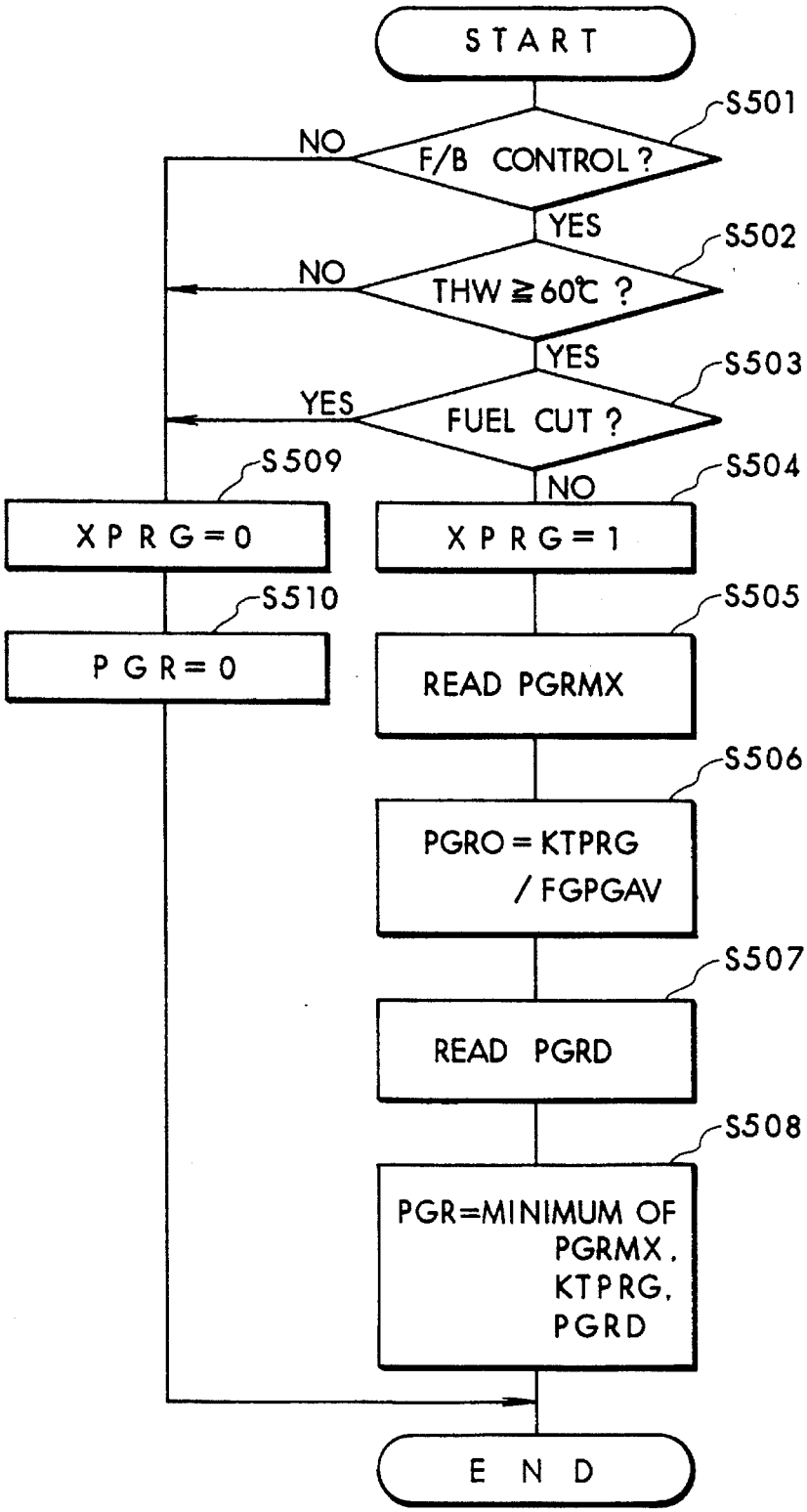
FIG. 5 is a flowchart of purge ratio control.
Figures 6A, 6B, 6C:
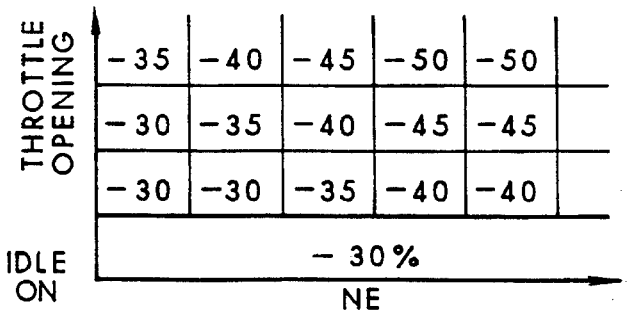

Purge ratio control is described below with reference to FIG. 5. It is first confirmed that the operation is under air-fuel ratio F/B control, the cooling water temperature THW is at least 60° C., and the fuel is not cut off in steps S501 to S503. Step S501 ensures that F/B contorl is being performed, and step S502 ensures that the cooling water temperature THW is at least 60° C. Step S503 ensures that purge is not executed during fuel cutting.

Processing proceeds to step S504 only when the answers in steps S501 and S502 are YES and the answer in step S503 is NO. When this is the situation, step S504 sets purge execution flag XPRG to 1. Otherwise, processing goes to step S509 where purge execution flag XPRG is set to 0. Then, at S510, final purge ratio PGR is set to 0 to complete processing. Final purge ratio PGR=0 means that purging is not necessary.

After setting purge execution flag XPRG to 1 in step S504, processing proceeds to step S505, where fully-open purge ratio PGRMX is read from the data map shown in FIG. 3 based upon the air intake pressure PM and the number of engine revolutions NE. Next, at step S506, target purge ratio PGRO is calculated from the target TAU correction quantity KTPRG and the evaporative gas concentration average value FGPGAV.

In this case, the target TAU correction quantity KTPRG expresses the maximum applicable decrement correction of the fuel injection quantity when replenishing fuel gas through purging. This target TAU correction quantity KTPRG has previously been determined on the basis of an allowance relative to the minimum injection pulse of the injector. It is converted into the form of a map as shown in FIGS. *6a–6c*, based upon parameters representing the operating conditions of the engine, and stored in ROM 34. FIG. *6a* illustrates the resulting map, which is used during idling and is based upon the number of engine revolutions NE. FIG. *6b* illustrates the result of two-dimensional mapping using the air intake pressure PM and the engine revolutions NE as parameters. FIG. *6c* illustrates another result of two-dimensional mapping, which uses the number of engine revolutions NE and the throttle opening as parameters. In all of the maps shown in FIGS. *6a–6c*, KTPRG tends to be smaller in an operating condition with a smaller basic fuel injection quantity.

The evaporative gas concentration average FGPGAV corresponds to the fuel gas adsorption quantity in canister 13. The value is estimated by processing, which is described later, and is written into RAM 35 while being periodically updated. Target purge ratio PGRO calculated in step S506 corresponds to the quantity of fuel gas to be replenished by purging on an assumption of full reduction of the injection quantity up to the target TAU correction quantity KTPRG. In the same operating condition, therefore, a larger evaporative gas concentration average FGPGAV leads to a smaller PGRO, and vice versa.

Once the target purge ratio PGRO is determined, purge ratio slow change value PGRD is read at step S507. Purge ratio slow change value PGRD is a control value provided in order to avoid circumstances in which a sudden increase in the purge ratio makes it impossible for correction to keep up with such increases and to maintain an optimum air-fuel ratio. Determination of purge ratio slow change value PGRD will be described in detail later as it relates to purge ratio slow change control.

When fully-open purge ratio PGRMX, target TAU correction quantity KTPRG, and purge ratio slow change value PGRD have been determined, the minimum value thereof is selected as the final purge ratio PGR in step S508. Purge control is executed based upon this final purge ratio PGR.

Purge ratio slow change value control

Purge ratio slow change value control will be described below with reference to FIG. 7. First at step S701, whether purge execution flag XPRG has been set is confirmed. In the case where XPRG=0, processing moves to step S706, where the purge ratio slow change value PGRD is set to 0 and processing is completed. When XPRG=1, processing proceeds to step S702, where the amount of shift of FAF, |1-FAFAV|, is determined. When |1-FAFAV|≦5%, the last purge ratio of the previous run, PGRi-1, is added with 0.1% at step S703 to form purge ratio slow change value PGRD. Processing is then completed. When 5%<|1-FAFAV|≦10%, purge ratio slow change value PGRD assumes the value of the last purge ratio of the previous run, PGRi-1, in step S704. Processing is then completed. When in the case of |1-FAFAV|>10%, then purge ratio slow change value PGRD is set to the last purge ratio of the previous run, PGRi-1, minus 0.1% in step S705. Processing is then completed.

In a state where FAF deviates from the theoretical or stoichiometric air-fuel ratio (FAF=1) by only 0.5% or less, TAU correction is considered to be capable of catching up with an even larger change in the purge ratio, and therefore, a larger change in the purge ratio is selected in this case.

When FAF remains within a deviation range of from 5 to 10% relative to the theoretical air-fuel ratio (FAF=1), the change in the purge ratio and the TAU correction are considered to be relatively in balance, and therefore, the purge ratio is maintained as is. A large deviation of over10% of FAF from the theoretical air-fuel ratio (FAF=1) is considered to mean that an excessive change in the purge ratio makes it impossible for TAU correction to catch up with the change in the purge ratio. If FAF is left as it is, deviation may be increased. Thus, some action is taken to restore the purge ratio to its original state.

Detection of evaporative gas concentration

FIG. 8 shows a main routine for the detection of the evaporative gas concentration, with the routine being executed about every 4 msec by CPU 21's base routine.

First, step S100 determines whether the key switch has been activated. This avoids an error that might be caused by the use of the value detected in the previous run because, during stoppage of the engine, evaporative fuel is further adsorbed by the canister. If the key switch is currently turned on, the answer in step S100 is YES, processing shifts to steps S115, S116 and S117, where the evaporative gas concentration FGPG and the evaporative gas concentration average value FGPGAV are set to 1.0, and the initial concentration detecting flag XNFGPG is initialized at 0. FGPG and FGPGAV being set to 1.0 mean that the evaporative gas concentration is 0 (no fuel gas is adsorbed). Initially, it is assumed that adsorption is nonexistent. XNFGPG=0 means that no evaporative gas concentration has as yet been detected. After setting the three values, processing is completed.

After turning on the key switch, i.e., NO in step S100, step S101 determines whether purge control has been started, i.e., whether or not the purge execution flag XPRG is 1. When XPRG=1 (purge control has already been started), processing proceeds to the step S102, and when XPRG=0 (purge control has not been started), concentration detecting processing comes to an end, because the evaporative gas concentration cannot be detected before start of purge.

At step S102, a determination is made as to whether speed is increasing or decreasing. This determination may be made by a commonly known method., such as through detection of the status of the idling switch, change in the opening of the throttle valve, change in the air intake pressure, or change in the vehicle speed. When the speed is determined to have increased or decreased at step S102, the processing is complete. During increase or decrease of speed, during which the operation is in a transient state, it is impossible to detect an accurate concentration.

If the operational status is determined to be such that the speed is neither increasing nor decreasing in step S102, a determination is made as to whether initial concentration detection end flag XNFGPG is 1 in step S103. If XNFGPG is equal to 1, processing proceeds to step S104, and if XNFGPG is not equal to 1, step S104 is bypassed and processing continues with step S105.

Figure 4:
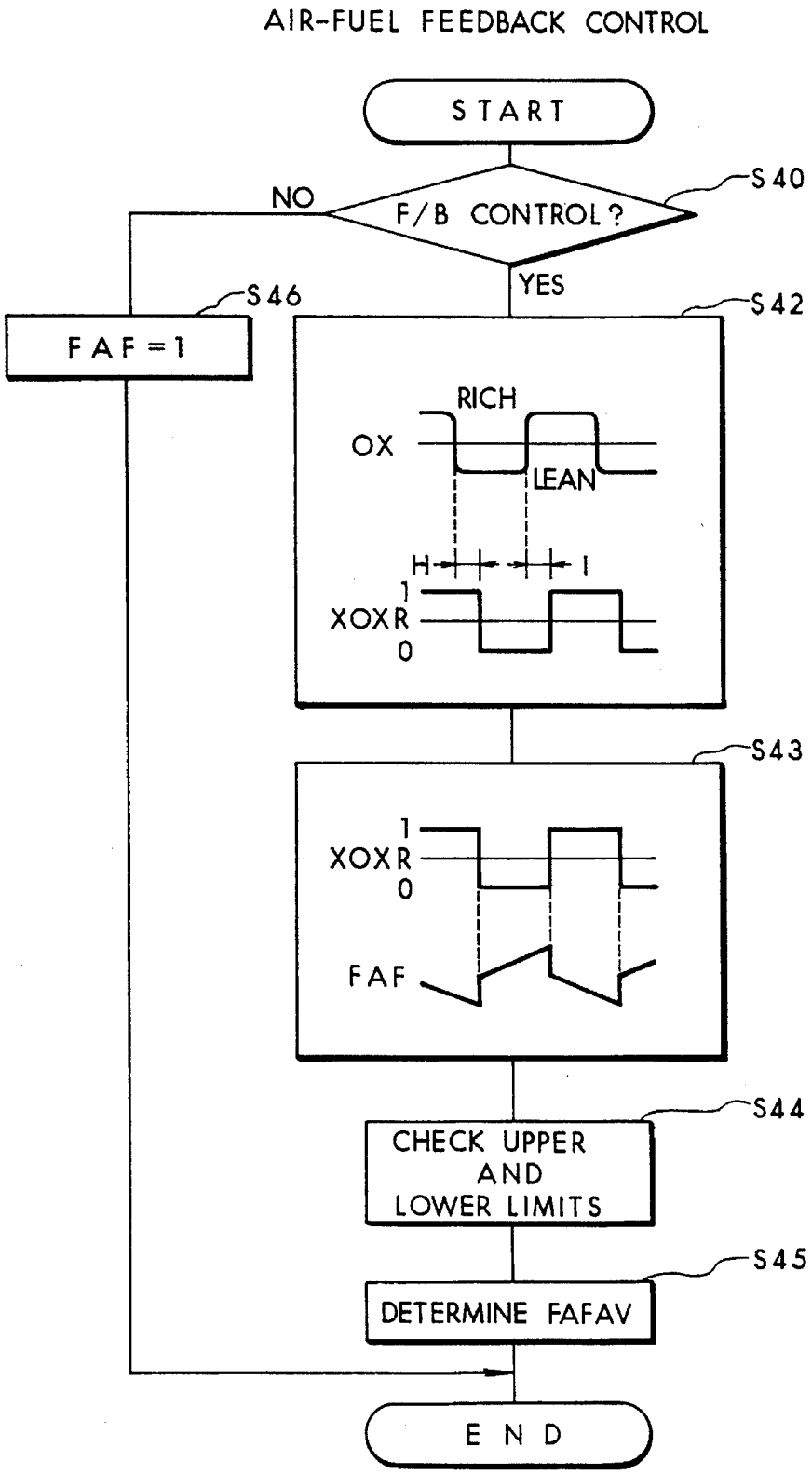
FIG. 4 is a flowchart of air-fuel feedback control.

In step S105, a determination is made as to whether FAFAV, a value arrived at in step S45 of FIG. 4, deviates a prescribed value (ω %) from the standard value of 1. The evaporative gas concentration cannot be accurately detected unless an apparent deviation exists in the air-fuel ratio as a result of purging. The prescribed value equals ω % and signifies the range of possible variations.

When the deviation does not exceed the prescribed value, i.e., the result is NO in step S105, the processing ends. Only when the deviation exceeds the prescribed value is the evaporative gas concentration detected in step S108.

At step S108, the deviation |FAFAV-1| is divided by PGR, and the quotient obtained is added to the evaporative gas concentration FGPG for the previous run to calculate a value of FGPG for the current run. Therefore, the value of the evaporative gas FGPG in the embodiment is set to 1 when the evaporative gas concentration in the discharge path 15 is 0 (100% air), and set to a value smaller than 1 as the evaporative gas concentration in the discharge path 15 becomes higher, accordingly. The evaporative gas concentration may be determined by replacing FAFAV with 1 in step S108. Thus, a higher evaporative gas concentration will lead to obtaining a larger FGPG value than 1.

In step S109, it is determined whether initial concentration detection end flag XNFGPG has been set to 1. If it is not 1, processing continues to step S110, and when it is 1, steps S110 and S111 are skipped and processing instead proceeds to step S112. In step S110, a determination is made concerning stability of the evaporative gas concentration. Such a determination will depend upon whether a state, in which the difference in the evaporative gas concentration FGPG between previous and current detections, is under a prescribed value (Θ%) and whether such a state has continued for three consecutive runs. When the evaporative gas concentration becomes stable, the initial concentration detection end flag XNFGPG is set to 1 at step S111, before processing continues to step S112. If the evaporative gas concentration is determined to be unstable at step S110, processing skips step S111 and continues with step S112. At step S112, a predetermined averaging operation (for example, 1/64 averaging) is executed to homogenize the current evaporative gas concentration FGPG, resulting in an evaporative gas concentration average value FGPGAV in step S112.

After completion of the initial concentration detection, the determination made in step S103 always is answered in the affirmative, i.e., YES, and step S104 is executed. When the purge ratio PGR is equal to, or under a prescribed value (β %), the processing ends. The processing proceeds to step S105 only when PGR>β %. When the purge ratio PGR is small, i.e., when the purge solenoid valve 16 is on the low flow rate side, the opening cannot be controlled with much accuracy, making it impossible to detect accurately the evaporative gas concentration. Apart from the initial run, detection of the evaporative gas concentration is attempted only when conditions for accurate detection are satisfied for the other runs to provide values as free from error as possible.

Fuel injection quantity control

Fuel injection quantity control, which is executed about every 4 msec by the CPU 21 base routine, is depicted in the flowchart of FIG. 9.

The air intake pressure PM is read in step S201, and substantially at the same time, the engine revolutions NE is read in step S202. Step S203 calculates the basic injection time τp (the fuel supply quantity in one supply to the internal combustion engine) in response to the air intake pressure PM and the engine revolutions NE by the use of an injection time two-dimensional map (not illustrated). Step 204 calculates the aspirated air temperature correction factor FTHA, which corrects the quantity of air intake on the basis of a detection signal of the aspirated air temperature sensor.

In steps 205 and 206, the normal correction factor FCON, which is always necessary for operating internal combustion engine 1, and the transient correction factor FTRN, which is necessary only upon transient operation of internal combustion engine 1, are separately calculated. FCON is calculated in step S205 while FTRN is calculated in step S206. More specifically, the normal correction factor FCON is set from the feedback correction factor FAF, the learning value FLAF and the EGR correction term FEGR (FCON=1+FAF+FLAF+FEGR). At this point, if all these terms FAF, FLAF and FEGR are "0," the constant correction factor FCON is set to "1." The transient correction factor FTRN is set from the acceleration increment FTA and the power steering increment FPS (FTRN=FTA+FPS). The acceleration increment FTA and the power steering increment FPS are set in response to the extent of change in the air intake pressure PM and the presence of power steering operation. The values FTA and FPS take a value of "0" except during transient operation. Then, the evaporative gas purge correction factor FPRG is calculated at step S207 by multiplying the evaporative gas concentration average FGPGAV by the final purge ratio PGR. The following step S208 calculates the corrected injection time τe by subtracting a quantity equal to a purge of evaporative gas from the basic injection time τp calculated at the step 203 described above. Namely, the corrected injection time τe is determined by the following formula (1):

$$\tau e = \tau p \cdot FTHA \cdot (FCON + FTRN) - \tau p \cdot FTHA \cdot FCON \cdot FPRG \quad (1)$$

According to formula (1), the decrement correction "τp·FTHA·FCON·FPRG" of the basic injection time τp takes a value proportional to the evaporative gas purge correction factor FPRG, and proportional also to the normal correction factor FCON. Therefore, even when the normal correction factor FCON largely deviates from "1" under the effect of learning control, the change in the normal correction factor FCON is reflected in the above-mentioned decrement correction. Since the normal correction factor FCON and the transient correction factor FTRN are separately set, incremental correction during transient operation is accomplished irrespective of purge correction of evaporative gas.

Subsequently, step S209 calculates the invalid injection time $\tau v$ dependent on battery voltage. The final injection time $\tau$ is calculated in step 210 by adding the corrected injection time $\tau e$ and the invalid injection time $\tau v$ ($\tau=\tau e+\tau v$). Thus, the injector 5 is driven and injects fuel for a period of the final injection time $\tau$.

The fuel supply quantity of injector 4 relative to the total fuel supply quantity to the internal combustion engine 1 will now be described.

FIG. 11 illustrates how factors associated with the fuel supply quantity after decrement correction change upon a large change in the normal. correction factor FCON as a reflection of learning control. In FIG. 11, the evaporative gas purge correction factor FPRG is represented by a one-point chain line (fixed at "0.3" in the drawing), and the factors associated with the fuel supply quantity after decrement correction (FCON–FCON·FPRG) are indicated by a solid line. For convenience, a constant operation is assumed in the current description, with a transient correction factor FTRN of "0."

According to FIG. 11, when there is no change in the normal correction factor FCON, i.e., the normal correction factor is constant with FCON="1.0," "FCON–FCON·FPRG" takes a value of "0.7." As a result, the fuel supply quantity based on evaporative gas is controlled to 30% of the total fuel supply quantity, and the fuel injection quantity based on the injector 5 is controlled to 70% of the total fuel supply quantity. The above-mentioned ratios are for the case where there is no change in the normal correction factor FCON.

When the normal correction factor FCON deviates from "1.0," i.e., when the normal correction factor FCON takes a value of "0.8", for example, as in FIG. 11, "FCON–FCON·FPRG" takes a value of "0.56." In this case, the fuel injection quantity injected by injector 5 is controlled to "0.56/0.8," i.e., 70% of the total fuel supply quantity. This means that even upon deviation of the normal correction factor FCON, the ratio for the case without change (70%) is maintained. With a normal correction factor FCON of "1.4," "FCON–FCON·FPRG" takes a value of "0.98," and also in this case, the fuel injection quantity from injector 5 relative to the total fuel supply quantity is controlled to "0.98/1.4," i.e., 70%. Irrespective of a change in the normal correction factor FCON, therefore, the fuel injection quantity from injector 5 relative to the total fuel supply quantity is always controlled to a desired quantity, thus permitting inhibition of disturbance in the air-fuel ratio conventionally encountered in an air-fuel ratio control system.

As described above in detail, the air-fuel ratio control system of this embodiment has a construction wherein evaporative gas generated in fuel tank 7 is adsorbed in canister 13, and then discharged to air intake pipe 2 of internal combustion engine 1. In an effort to estimate the quantity of discharged evaporative gas, purge ratio PGR of evaporative gas and evaporative gas concentration FGPGAV are calculated, and evaporative gas purge correction factor FPRG is calculated from the values for PGR and FGPGAV. Since normal correction factor FCON is always associated with operation of internal combustion engine 1, its value is calculated from feedback correction factor FAF, learning value FLAF, and EGR correction term FEGR. For air-fuel ratio control purposes, the fuel supply quantity (having basic injection time $\tau p$) to internal combustion engine 1 is corrected in response to the normal correction factor FCON. When performing decrement correction of the fuel supply quantity (basic injection quantity $\tau p$) to internal combustion engine 1 in response to evaporative gas purge correction factor FPRG, i.e., when calculating the fuel injection quantity of injector 5, the quantity of this decrement correction is made proportional to normal correction factor FCON. In summary, when the normal correction factor FCON, which includes the air-fuel ratio correction factor, is kept at a certain value (e.g., FCON="1.0"), it is usually sufficient to set the quantity of decrement correction of the fuel supply quantity to internal combustion engine 1 in response to the quantity of discharged evaporative gas. However, when normal correction factor FCON deviates from a certain value due to the passage of time or due to individualized differences between system users, the fuel quantity corrected under air-fuel ratio control varies with the normal correction factor FCON. As a result, the decrement correction of the fuel quantity in response to the quantity of discharged evaporative gas leads to either a shortage or an excess in the quantity of injected fuel from injector 5, or causes the air-fuel ratio to shift to either the leaner side or to the richer side.

In contrast, when the quantity of decrement correction based on the quantity of discharged evaporative gas is proportional to normal correction factor FCON as in the present embodiment, the injected fuel quantity from injector 5 may always be controlled to a desired value, irrespective of changes in normal correction factor FCON. This results in a stable air-fuel ratio, which always permits achievement of accurate air-fuel ratio control and inhibits emission deterioration.

In the present embodiment, transient correction factor FTRN, necessary upon transient operation of internal combustion engine 1, has been set so as to perform increment correction of the fuel supply quantity in response to the transient correction factor FTRN, separately from the air-fuel ratio correction based on the normal correction factor FCON and the decrement correction based on evaporative gas. More specifically, the increment correction based on transient operation should preferably be set in response to the level of transition, and executed separately from the other corrections. Upon acceleration, for example, it is necessary to have an acceleration increment term. Correction based on this acceleration increment term, without discriminating from the normal correction factor FCON, may cause a correction of air-fuel ratio control to become an over-correction. Therefore, separation of the normal correction factor FCON from the transient correction factor FTRN, as in this embodiment, ensures a highly accurate air-fuel ratio control even during a transient operation.

The present invention is not limited to the above-mentioned embodiment, but may be also be embodied in the following form, among others.

In the above-mentioned embodiment, normal correction factor FCON has been set as a sum of feedback correction factor FAF, learning value FLAF, and EGR correction factor FEGR. However, the normal correction factor FCON may be set as a sum of only feedback correction factor FAF and learning value FLAF, or by adding the other correction terms associated with constant operation.

Purge solenoid valve control

The purge solenoid valve control routine is executed by time interruption every 100 msec by CPU 21. The routine is shown in the flowchart of FIG. 10. At step S305, a determination is made whether purge is in underway based on the status of the purge execution flag XPRG. When XPRG=0 (purge is not in execution), the control value, Duty of purge solenoid valve 16, is set to 0 in step S306. When XPRG=1, processing proceeds to step S307, where the amount of intake air Qa supplied to the internal combustion engine is calculated on the basis of the engine revolutions NE and the air intake pressure PM. Furthermore, the purge flow rate Qp is calculated by multiplying the final purge ratio PGR by the quantity of air intake Qa. In step S308, the duty ratio relative to the purge flow rate Qp is calculated on the basis of a map representing the relationship between the purge flow rate (liter/min) and the duty ratio (%) as shown in FIG. 12. The map of FIG. 12 is experimentally determined based on the pressure difference (mmHg), repesenting the difference between before and after the position of purge solenoid valve 16 in discharge path 15, and the drive frequency (Hz) of the purge solenoid valve 16 as parameters. As is evident from FIG. 13, when the duty ratio exceeds about 20%, the purge flow rate and the duty ratio show stable changes. That is, they have a substantially linear relationship. In step S309 of FIG. 10, a determination is made as to whether the duty ratio exceeds γ. This γ-value represents the critical duty ratio for the stable supply of purge flow rate. When the duty ratio is greater than γ, output to purge solenoid valve 16 is permitted. This critical duty ratio γ is calculated from the map shown in FIG. 12 derived from the pressure difference (mmHg) and the drive frequency (Hz) of purge solenoid valve 16. In FIG. 12, the critical duty ratio γ in the middle of the map was calculated by interpolation. When the duty ratio is under γ at the step S309, processing moves to step S306, due to the determination that an adverse effect would be exerted on the behavior of the internal combustion engine, and at the step S306, the control value duty of the purge solenoid valve 16 is set to 0. When the duty ratio exceeds γ in step S309, processing skips to step S310, where a pulse signal corresponding to the duty ratio is issued to purge solenoid valve 16 for execution of purge control.

The present invention has been described with what are currently considered to be the best embodiments of the present invention. However, this application is not to be limited to the disclosed embodiments, but rather is intended to cover various modifications and alternative arrangements included within the spirit and scope of the appended claims.

What is claimed is:

1. An air-fuel ratio control system for an internal combustion engine, which stores fuel evaporative gas generated in a fuel tank in a canister and discharges said fuel evaporative gas stored in said canister, together with air, from said canister through a discharge path connected to an intake side of said internal combustion engine, said air-fuel ratio control system comprising:

air-fuel ratio detecting means for detecting an airfuel ratio of a mixed gas supplied to said internal combustion engine;

air-fuel ratio feedback means for controlling the air-fuel ratio of a mixed gas to be supplied to said internal combustion engine via feedback control, said air-fuel feedback means operating based on said air-fuel ratio detected by said air-fuel ratio detecting means;

a flow control valve disposed in substantially a middle of said discharge path and causing a change in a purge ratio of air containing said evaporative gas;

purge ratio setting means for one of increasing and decreasing said purge ratio on the basis of deviation from a predetermined air-fuel ratio feedback value from said air-fuel ratio feedback means;

determining means for determining whether a duty ratio of said flow control valve corresponding to a purge flow rate calculated from said purge ratio and an intake air amount is greater than a prescribed ratio; and driving means for driving said flow control valve based upon a duty ratio when said duty ratio is determined to exceed said prescribed value by said determining means.

2. A canister purge apparatus that causes a canister to adsorb fuel evaporative gas generated in a fuel tank of an internal combustion engine and purge said adsorbed fuel evaporative gas during a prescribed operation of the engine into an intake pipe, said canister purge apparatus comprising:

a purge control valve disposed between said canister and said intake pipe, and having a flow control rate function capable of adjusting a purge quantity of fuel evaporative gas in response to an opening/closing status thereof;

concentration detecting means that detects the concentration of fuel evaporative gas contained in gas purged from said canister;

operating condition detecting means that detects the operating condition of said internal combustion engine; and critical purge means that, within a limit of decrement correction of the fuel injection quantity in air-fuel ratio control, performs purge flow rate control by means of said purge control valve so as to be as close as possible to said limit, with reference to results of detection of said concentration detecting means and said operating condition detecting means.

3. A fuel evaporative gas control system comprising:

an internal combustion engine including:

an air intake pipe and an exhaust pipe;

an injector attached to said intake pipe; and a throttle valve attached to said intake pipe;

a fuel tank;

a purge pipe extending from said fuel tank;

a canister for adsorbing fuel evaporative gas connected to an end of said purge pipe opposite to the fuel tank;

a control means for controlling purging of said fuel evaporative gas control system;

a purge solenoid valve controlled by said control means, said purge solenoid valve allowing purging of said canister; and wherein said system has a constant correction factor required for operation of said internal combustion engine, such that an air-fuel ratio of the system is stable so that a quantity of discharged gas is proportional to said constant correction factor.

4. A system as claimed in claim 3, wherein said control means determines an injection time in accordance with the following equation (1):

$$\tau e=\tau p\cdot FTHA\cdot(FCON+FTRN)-\tau p\cdot FTHA\cdot FCON\cdot FPRG \quad (1)$$

wherein τe is the injection time, τp is the basic injection time, FTHA is the aspirated air temperature correction factor, FCON is the normal correction factor necessary for operating an internal combustion engine, FTRN is the transient correction factor, and FPRG is evaporative gas purge correction factor.

5. An air-fuel ratio control system for an internal combustion engine, having a canister for adsorbing therein fuel evaporative gas generated in a fuel tank and discharging therefrom said fuel evaporative gas to an air intake pipe, said system comprising:

fuel injection-means for injecting fuel into said internal combustion engine;

air-fuel ratio detecting means for detecting an air-fuel ratio of a mixture gas supplied to said engine;

operating condition detecting means for detecting operating conditions of said engine;

fuel injection time calculation means for calculating a basic fuel injection time in accordance with said detected operating conditions;

air-fuel control means for calculating an air-fuel ratio correction factor in accordance with said detected air-fuel ratio and correcting said calculated injection time by said air-fuel ratio correction factor;

fuel decrement means for decrementing said basic fuel injection time by an evaporative gas correction factor related to a fuel evaporative gas amount discharged from said canister into said air intake pipe, said evaporative gas correction factor being determined in proportion to a normal correction factor including said air-fuel ratio correction factor; and fuel increment means for incrementing, independently of said fuel decrement means, said injection amount by a transient correction factor determined only during an engine transient condition.

6. A system as claimed in claim 5, further comprising:

evaporative gas detecting means for detecting a concentration of said evaporated gas discharged from said canister; and purge limit means for maintaining a purge flow rate of said flow rate control means at a value proximate a limit of said decrement correction in said air-fuel ratio control in accordance with said detected air-fuel ratio and said detected evaporated gas concentration.

7. A system as claimed in claim 5, further comprising:

flow rate control means for controlling in accordance with a duty ratio of said system an amount of purge air including said evaporated gas discharged from said canister to said intake air pipe;

purge rate setting means for setting a purge rate of said purge air in accordance with a deviation of said air-fuel ratio correction factor from a predetermined air-fuel ratio so that said duty ratio is determined thereby;

duty ratio determining means for determining whether said duty ratio of said flow rate control means corresponding to said purge rate is above a predetermined duty ratio; and drive means for driving said flow rate control means only when said duty ratio is above said predetermined duty ratio.

8. A system as claimed in claim 7, further comprising:

evaporative gas detecting means for detecting a concentration of said evaporated gas discharged from said canister; and purge limit means for maintaining a purge flow rate of said flow rate control means at a value proximate a limit of said decrement correction in said air-fuel ratio control in accordance with said detected air-fuel ratio and said detected evaporated gas concentration.

9. A system as claimed in claim 5, wherein said fuel injection time is corrected in accordance with the following equation (1):

$$\tau e = \tau p \cdot FTHA \cdot (FCON + FTRN) - \tau p \cdot FTHA \cdot FCON \cdot FPRG \quad (1)$$

wherein $\tau e$ is the injection time, $\tau p$ is the basic injection time, FTHA is the aspirated air temperature correction factor, FCON is the normal correction factor necessary for operating an internal combustion engine, FTRN is the transient correction factor, and FPRG is evaporative gas purge correction factor.

10. A system as claimed in claim 9, wherein said normal correction factor FCON is calculated from a learning control factor FLAF calculated from said air-fuel ratio control factor FAF, and an exhaust gas recirculation correction factor FEGR corresponding to exhaust gas recirculation.

11. A system as claimed in claim 10, further comprising:

evaporative gas detecting means for detecting a concentration of said evaporated gas discharged from said canister; and purge limit means for controlling a purge flow rate of said flow rate control means to a value close to a limit of said decrement correction in said air-fuel ratio control in accordance with said detected air-fuel ratio and said detected evaporated gas concentration.

12. A system as claimed in claim 10, further comprising:

flow rate control means for controlling in accordance with a duty ratio thereof an amount of purge air including said evaporated gas discharged from said canister to said air intake pipe;

purge rate setting means for setting a purge rate of said purge air in accordance with a deviation of said air-fuel ratio correction factor from a predetermined air-fuel ratio so that said duty ratio is determined thereby;

duty ratio determining means for determining whether said duty ratio of said flow rate control means corresponding to said purge rate is above a predetermined duty ratio; and drive means for driving said flow rate control means only when said duty ratio is above said predetermined duty ratio.

13. A system as claimed in claim 12, further comprising:

evaporative gas detecting means for detecting a concentration of said evaporated gas discharged from said canister; and purge limit means for maintaining a purge flow rate of said flow rate control means at a value proximate a limit of said decrement correction in said air-fuel ratio control in accordance with said detected air-fuel ratio and said detected evaporated gas concentration.

* * * * *